US007040198B2

(12) United States Patent
Gelpi, Jr.

(10) Patent No.: US 7,040,198 B2
(45) Date of Patent: May 9, 2006

(54) IN-LINE STRAP WRENCH

(76) Inventor: James Joseph Gelpi, Jr., 916 Richard St, Gretna, LA (US) 70053

( * ) Notice: Subject to any disclaimer, the term of this patent is extended or adjusted under 35 U.S.C. 154(b) by 29 days.

(21) Appl. No.: 10/710,992

(22) Filed: Aug. 16, 2004

(65) Prior Publication Data

US 2006/0032342 A1 Feb. 16, 2006

(51) Int. Cl.
*B25B 13/52* (2006.01)

(52) U.S. Cl. ..... 81/64; 81/3.43; D8/22

(58) Field of Classification Search ..... 81/64, 81/3.43; D8/22

See application file for complete search history.

(56) References Cited

U.S. PATENT DOCUMENTS

| | | | | |
|---|---|---|---|---|
| 1,911,815 | A * | 5/1933 | Deringer et al. | 81/64 |
| 2,787,924 | A * | 4/1957 | Hammer | 81/3.43 |
| 3,962,936 | A * | 6/1976 | Lewis | 81/64 |
| D369,076 | S * | 4/1996 | Alexander | D8/22 |
| 2002/0092381 | A1 * | 7/2002 | Khubani | 81/64 |

* cited by examiner

*Primary Examiner*—Debra S Meislin

(57) ABSTRACT

A wrenching tool with an anchored flexible strap that is placed around the rotating part of a screw type connector, the strap then being slide fitted and adjusted in one of two angular slots on the tool for the purpose of tightening or loosening the connector. With proper fitting and adjustment of the strap, a rotation of the tool, which is generally parallelingly in line but offset from the axis of the connector, causes a bight by the strap being restricted on the connector that will, depending on the slot used, tighten or loosen the connector.

1 Claim, 3 Drawing Sheets

IN-LINE STRAP WRENCH

BACKGROUND ART

The invention relates to a strap wrench, hereinafter referred to as an in-line strap wrench, particularly for use in tightening or loosening screw type connectors situated in a cluster or whereby a typical perpendicular to the connector wrenching device cannot be accommodated or used due to workspace constraints.

The in-line strap wrench is a wrenching tool with an anchored flexible non-metallic strap that is placed around the rotating part of a screw type connector, the strap then being slide fitted and adjusted in one of two angular slots on the tool for the purpose of tightening or loosening the connector. With proper fitting and adjustment of the strap, a proper rotation of the tool, which is generally parallelingly in line but offset from the axis of the connector, causes a bight by the strap being restricted on the connector that will, depending on the slot used, tighten or loosen the connector and at the same time prevent if from damaging the connector in any manner.

This invention falls in the category of strap wrenches of the type comprising a non-metallic flexible band having an adjustable size where one end of the strap is anchored to the tool and the other end of the strap is not attached and is meant to pass through a slot on the same tool; examples of this type of strap wrench are found in U.S. Pat. Nos. 701,489; 2,186,430; 2,995,965; and 4,750,389.

This invention also falls within that category of strap wrenches of the type that have a turning motion that produces the wrenching action that is in line but offset from the axis of the device being turned; examples of this type of strap wrench can be found in U.S. Pat. Nos. 2,787,924; 2,995,965; 3,962,936; 4,506,568; 4,646,593; 4,750,389; 4,987,804; and 6,089,126.

This invention also falls within that category of strap wrenches that is elemental in that the strap wrench element of the tool requires a separate turning device such as a nut driver, socket drive, torque measuring screwdriver, and other such drives to provide the effective turning motion for the tool to work properly; examples of this type of strap wrench can be found in U.S. Pat. Nos. 2,995,965; 3,962,936; 4,506,568; 4,646,593; 4,750,389; 4,987,804; 6,089,126.

MODE FOR INVENTION

Figure 1:
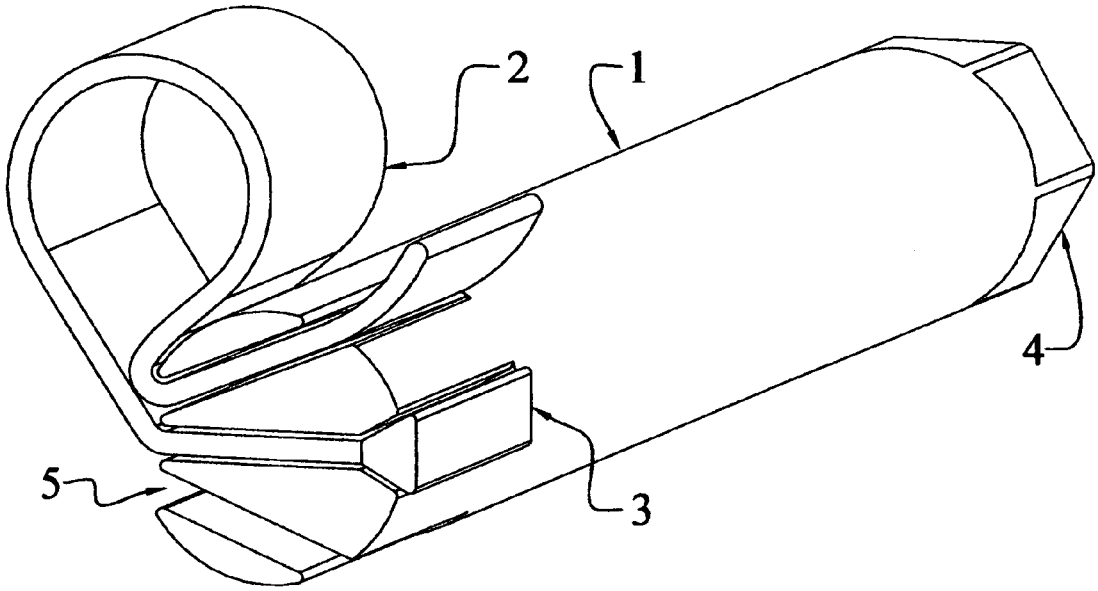
FIG. 1 is a perspective view of the in-line strap wrench as would be engaged on a connector in a tightening operation.

These illustrations are not scaled or intended to limit the scope of the teachings of the invention, but are merely illustrative. There may be some adaptations and variations (such as, but not limited to, connectors or objects with threads that turn in the opposite direction to that of the norm) to part of these teachings depending upon the dictates of the workplace and practices of the commercial and technical bodies involved. References and item numbers made in the drawings are designating the same parts throughout these teachings.

The main element 1 of the in-line strap wrench is mainly cylindrical with slots 5, 6, 7 cut into one end; and a drive arrangement 8 and 9 on the opposite end. The slots are hereby described as the anchoring slot 7 in which the flexible strap 2 is fed through to its bulbous entity 3 and snugged into the anchor notch 4 with the objective of creating a secure anchor point for the purposes of the strap wrenching exercise; the tightening slot 6 is the slot through which the plain end of the flexible strap 2 is fed through as part of the tightening exercise; or the loosening slot 5 through which the plain end of the flexible strap 2 is fed through as part of the loosening exercise. The opposite end of the main element 1 is the drive arrangement which consists of a hex configuration 9, of the same size and dimensions as a standard hex nut, and an alternative drive notch 8, of the same size and dimensions as any standard socket wrench drive output.

The in-line strap wrench also comprises a replaceable flexible flat strap 2 of durable woven fabric, or other such suitable material, with a length sufficiently greater than the measured circumference of the connector or object being tightened or loosened and a width substantially the same but not greater than the length of the connector or object being tightened or loosened. The strap 2 is constructed in such a way as to have a bulbous entity 3 on one end; and the bulbous entity 3 being of an outside diameter or thickness greater than the width of the anchor slot 7 and able to fit snuggly in the anchor notch 4.

Figure 2:
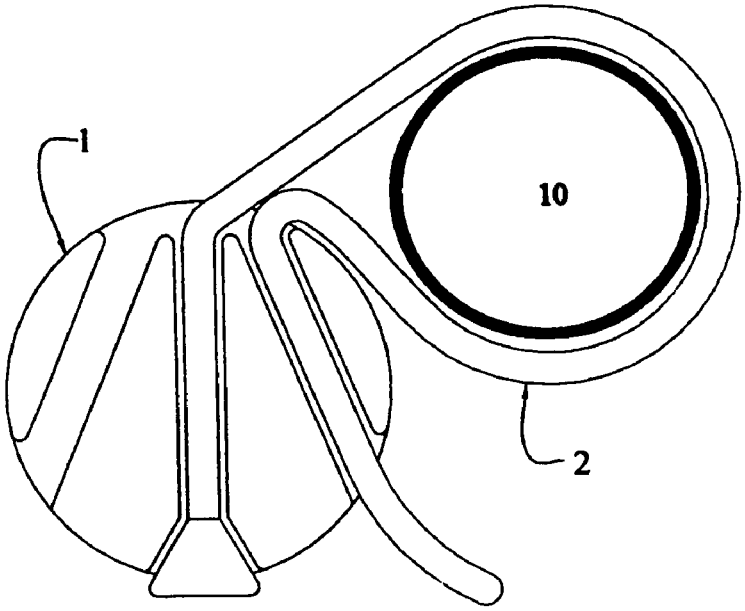
FIG. 2 is an elevation view of the slotted end of the in-line strap wrench showing the flexible strap routing when the tool is used for tightening a connector.

At one end of the main element 1 is the drive arrangement, which consists of a hex configuration 9 and an alternative drive notch 8. Prior to engaging the in-line strap wrench to tighten a connector, the operator shall determine, based on the workspace requirements and availability, what type of turning device, such as a nut driver, socket, torque measuring screwdriver, and other such drives, is required and affix it to the main element 1 using the hex configuration 9; or if a standard socket wrench drive, with or without an extension, is required and affixing it to the main element 1 using the drive notch 8. With the desired turning mechanism affixed to the main element 1 complete with the flexible strap 2 installed as described earlier, the tool is ready to tighten a connector. Placing the slotted end of the main element 1 in the proximity of the connector assembly 10, wrap the strap 2 without twisting it out of the plane of the slot, around the connector assembly 10 and guiding the loose end of the strap 2 into its tightening slot 6; adjust the main element 1 and the flexible strap 2 so the strap fits snuggly and in relationship to the connector as shown in FIG. 2; with the slotted end of the main element in parallel with the connector being tightened, turn the drive mechanism in a clockwise motion.

Figure 3:
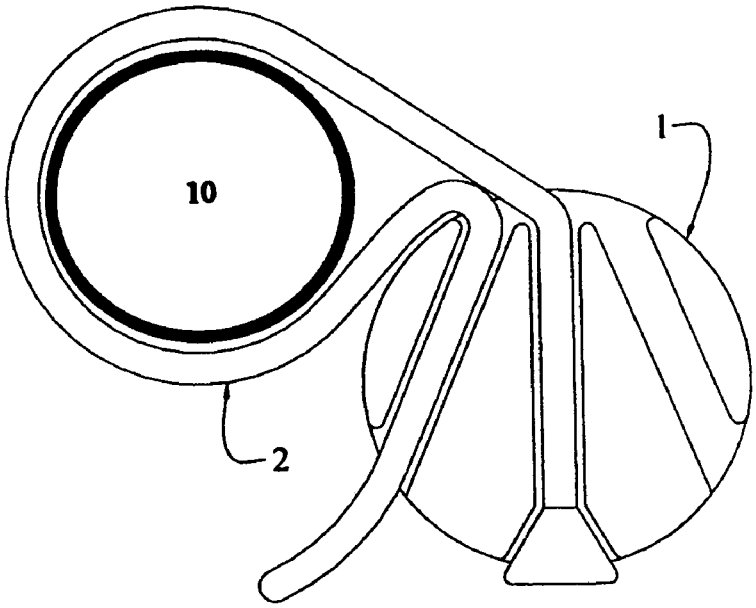
FIG. 3 is an elevation view of the slotted end of the in-line strap wrench showing the flexible strap routing when the tool is used for loosening a connector.
Figure 4:
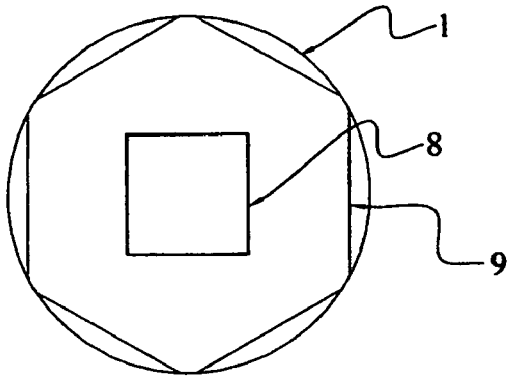
FIG. 4 is an elevation view of the drive end of the in-line strap wrench.
Figure 5:
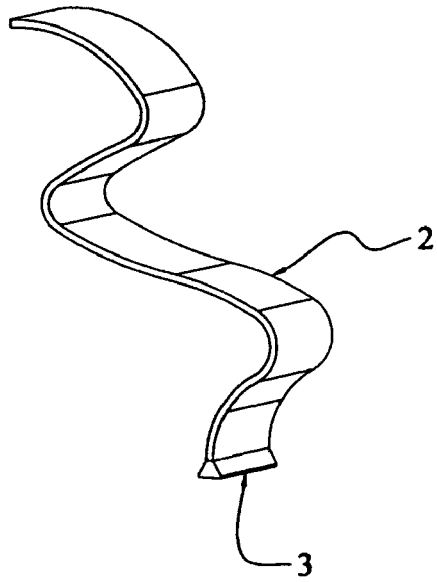
FIG. 5 is a perspective view of the strap.
Figure 6:
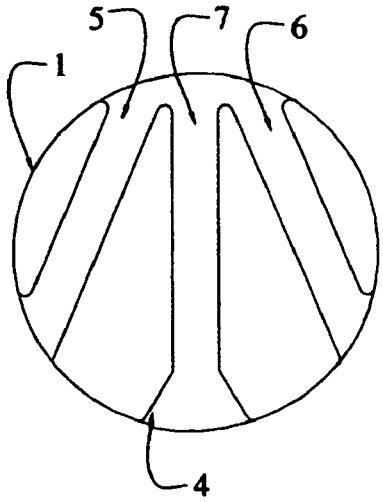
FIG. 6 is an elevation view of the slotted end of the in-line strap wrench.

With the desired turning mechanism affixed to the main element 1 complete with the flexible strap 2 installed as described earlier, the tool can also be ready to loosen a connector. To loosen a connector place the slotted end of the main element 1 in the proximity of the connector assembly 10, wrap the strap 2 without twisting it out of the plane of the slot, around the connector assembly 10 and guiding the loose end of the strap 2 into its tightening slot 5; adjust the main element 1 and the flexible strap 2 so the strap fits snuggly and in relationship to the connector 10 as shown in FIG. 3; with the slotted end of the main element 1 in parallel with the connector being loosened, turn the drive mechanism in a counter clockwise motion.

The invention claimed is:

1. An assembled strap wrench for gripping and turning a connector comprising:

a cylindrical metal rod with three axial non-parallel slots located at one end of said rod, said three slots extending through said rod and converge at a common point, said three slots a comprising first slot, a central second slot and a third slot, said central second slot having an enlarged anchor notch at one end thereof, a non-metallic strap having an bulbous end, said bulbous end of said strap being anchored within said enlarged anchor notch of said central second slot, said strap extending through the opposite end of said central second slot and engageable with a selected one of the first or third slots, wherein, said strap engaged with said central second slot, about the connector and threaded through said first slot allows for tightening of the connector and said strap engaged with said central second slot, about the connector and threaded through said third slot allows for loosening the connector.

* * * * *